US009307881B2

(12) United States Patent
Salo et al.

(10) Patent No.: US 9,307,881 B2
(45) Date of Patent: Apr. 12, 2016

(54) EXTRACTOR CLEANING MACHINE

(71) Applicant: TECHTRONIC INDUSTRIES CO. LTD., Tsuen Wan, New Territories (HK)

(72) Inventors: Robert Salo, Mentor, OH (US); Luke Phalen, Streetsboro, OH (US)

(73) Assignee: Techtronic Industries Co. Ltd., Tsuen Wan, New Territories (HK)

( * ) Notice: Subject to any disclaimer, the term of this patent is extended or adjusted under 35 U.S.C. 154(b) by 104 days.

(21) Appl. No.: 14/206,150

(22) Filed: Mar. 12, 2014

(65) Prior Publication Data

US 2015/0257620 A1 Sep. 17, 2015

(51) Int. Cl.

| | |
|---|---|
| ***A47L 11/34*** | (2006.01) |
| ***A47L 11/40*** | (2006.01) |
| ***A47L 5/14*** | (2006.01) |

(52) U.S. Cl.

CPC . *A47L 11/34* (2013.01); *A47L 5/14* (2013.01); *A47L 11/4044* (2013.01); *A47L 11/4083* (2013.01); *A47L 11/4088* (2013.01); *A47L 11/4097* (2013.01)

(58) Field of Classification Search

CPC . A47L 11/34; A47L 11/4086; A47L 11/4088; A47L 11/4083; A47L 11/4044; A47L 11/30

See application file for complete search history.

(56) References Cited

U.S. PATENT DOCUMENTS

| | | | |
|---|---|---|---|
| 5,289,610 | A | 3/1994 | Monson |
| 5,392,490 | A | 2/1995 | Monson |
| 5,799,363 | A | 9/1998 | Inoue et al. |
| 5,930,864 | A | 8/1999 | Inoue et al. |
| 6,345,411 | B1 | 2/2002 | Kato et al. |
| 6,505,379 | B2 | 1/2003 | Keller |
| 6,553,613 | B2 | 4/2003 | Onishi et al. |
| 6,684,451 | B2 | 2/2004 | Kato et al. |
| 6,812,847 | B1 | 11/2004 | Salem et al. |
| 6,832,407 | B2 | 12/2004 | Salem et al. |
| 7,000,286 | B2 | 2/2006 | Wang |
| 7,356,875 | B2 | 4/2008 | Abdallah et al. |
| 7,475,451 | B2 | 1/2009 | Lenkiewicz et al. |

(Continued)

FOREIGN PATENT DOCUMENTS

| | | |
|---|---|---|
| EP | 0668043 | 8/1995 |
| WO | 2015/031134 | 3/2012 |

OTHER PUBLICATIONS

International Search Report and Written Opinion for Application No. PCT/US2015/013693 dated Apr. 28, 2015 (11 pages).

*Primary Examiner* — Robert Scruggs

(74) *Attorney, Agent, or Firm* — Michael Best & Friedrich LLP

(57) ABSTRACT

An extractor cleaning machine that includes a base having a base exhaust duct having an exhaust outlet directed toward a surface being cleaned. The extractor further includes a suction source that is operable to generate an airflow that is discharged through the exhaust outlet of the base and onto the surface, which is configured to at least partially dry the surface. The extractor further includes a body pivotally coupled to the base such that the body is pivotable between an upright position and an inclined position, and the body includes a body exhaust duct that is movable relative to the base exhaust duct as the handle pivots between the upright position and the inclined position. The base exhaust duct and the body exhaust duct cooperate to form an exhaust passageway between the suction source and the exhaust outlet.

21 Claims, 7 Drawing Sheets

(56) References Cited

U.S. PATENT DOCUMENTS

| | | | | |
|---|---|---|---|---|
| 7,581,284 | B2 | 9/2009 | Courtney | |
| 7,581,285 | B2 | 9/2009 | Courtney | |
| 7,600,292 | B2 | 10/2009 | Courtney | |
| 7,610,653 | B2 | 11/2009 | Courtney | |
| 7,757,343 | B2 | 7/2010 | Courtney | |
| 7,793,385 | B2 | 9/2010 | Huffman | |
| 7,845,045 | B2 | 12/2010 | Lenkiewicz et al. | |
| 7,891,049 | B1 | 2/2011 | Miner | |
| 7,958,652 | B2 | 6/2011 | Huffman et al. | |
| 8,028,373 | B2 | 10/2011 | Rowntree | |
| 8,176,649 | B2 | 5/2012 | Huffman et al. | |
| 8,650,708 | B2 | 2/2014 | Dyson et al. | |
| 2001/0023517 | A1 | 9/2001 | Onishi et al. | |
| 2002/0059689 | A1 | 5/2002 | Kato et al. | |
| 2002/0092116 | A1* | 7/2002 | Zahuranec et al. | 15/320 |
| 2003/0126715 | A1* | 7/2003 | Krymsky et al. | 15/346 |
| 2004/0088820 | A1 | 5/2004 | Kato et al. | |
| 2004/0177473 | A1 | 9/2004 | Abdallah et al. | |
| 2005/0050671 | A1 | 3/2005 | Brennan et al. | |
| 2005/0166358 | A1 | 8/2005 | Lee et al. | |
| 2005/0223516 | A1 | 10/2005 | Courtney | |
| 2005/0223517 | A1 | 10/2005 | Courtney | |
| 2005/0235454 | A1 | 10/2005 | Courtney | |
| 2005/0283939 | A1 | 12/2005 | Theiss, Jr. et al. | |
| 2008/0022482 | A1 | 1/2008 | Courtney | |
| 2008/0229539 | A1 | 9/2008 | Hwang et al. | |
| 2008/0256744 | A1 | 10/2008 | Rowntreer et al. | |
| 2009/0019663 | A1 | 1/2009 | Rowntree | |
| 2009/0288268 | A1 | 11/2009 | Courtney | |
| 2011/0088211 | A1 | 4/2011 | Dyson et al. | |
| 2011/0308038 | A1 | 12/2011 | Rowntree | |
| 2012/0304416 | A1 | 12/2012 | Nguyen et al. | |

* cited by examiner

EXTRACTOR CLEANING MACHINE

BACKGROUND

The present invention relates to extractor cleaning machines and, more particularly, to airflow exhaust for extractor cleaning machines.

Extractor cleaning machines typically include a supply tank for storing a cleaning fluid or a mixture of cleaning fluids. The extractor discharges the cleaning fluid onto a surface to be cleaned. A suction source, such as a motor and fan, draw the cleaning fluid and dirt from the surface through a suction nozzle and into a recovery tank. In the recovery tank, the airflow generated by the suction source is separated from the cleaning fluid and dirt and the cleaning fluid and dirt are stored in the recovery tank. The airflow is discharged from the extractor.

SUMMARY

In embodiment the invention provides an extractor cleaning machine that includes a supply tank configured to store a cleaning fluid and a base movable along a surface to be cleaned. The base includes a base exhaust duct having an exhaust outlet directed toward the surface, and the base further includes a suction nozzle and an aperture configured to spray the cleaning fluid onto the surface. The extractor further includes a recovery tank in fluid communication with the suction nozzle and the recovery tank is configured to store cleaning fluid drawn through the suction nozzle. A suction source is in fluid communication with the suction nozzle and the recovery tank, and the suction source is operable to draw the cleaning fluid through the suction nozzle and into the recovery tank. The suction source is operable to generate an airflow that is discharged through the exhaust outlet of the base and onto the surface. The extractor further includes a body pivotally coupled to the base such that the body is pivotable between an upright position and an inclined position, and the body includes a body exhaust duct that is movable relative to the base exhaust duct as the handle pivots between the upright position and the inclined position. The base exhaust duct and the body exhaust duct cooperate to form an exhaust passageway between the suction source and the exhaust outlet.

In another embodiment, the invention provides a floor cleaning machine including a base movable along a surface to be cleaned, the base including a suction nozzle and a base exhaust duct and an exhaust outlet. The extractor further includes a suction source in fluid communication with the suction nozzle, and the suction source is operable to generate an airflow that is discharged through the exhaust outlet. The extractor further includes a body portion pivotally coupled to the base, and the body portion includes a body exhaust duct that is movable relative to the base exhaust duct as the handle pivots relative to the base. The base exhaust duct and the body exhaust duct cooperate to form an exhaust passageway between the suction source and the exhaust outlet.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
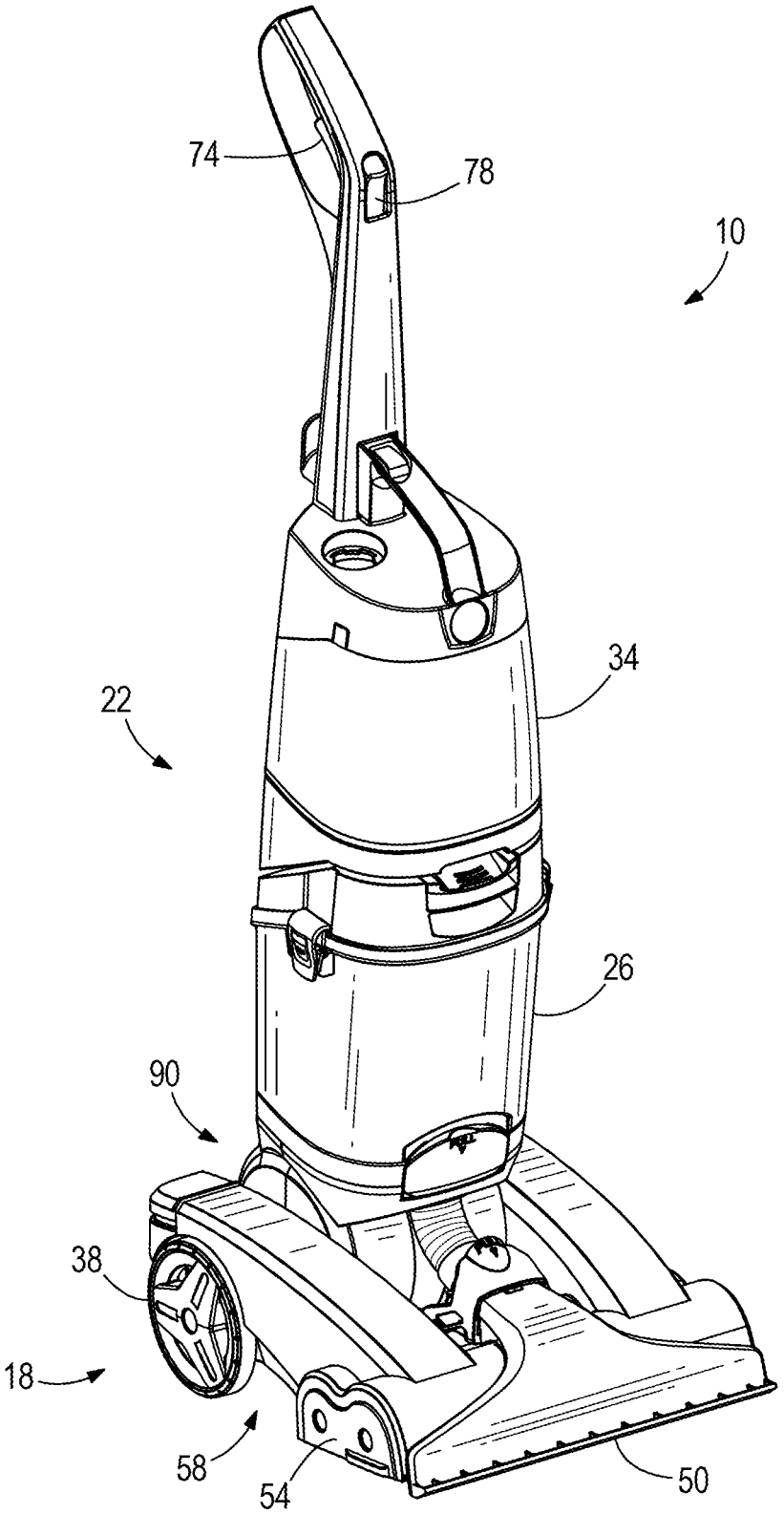
FIG. 1 is a perspective view of an extractor cleaning machine according to one embodiment of the invention.
Figure 7:
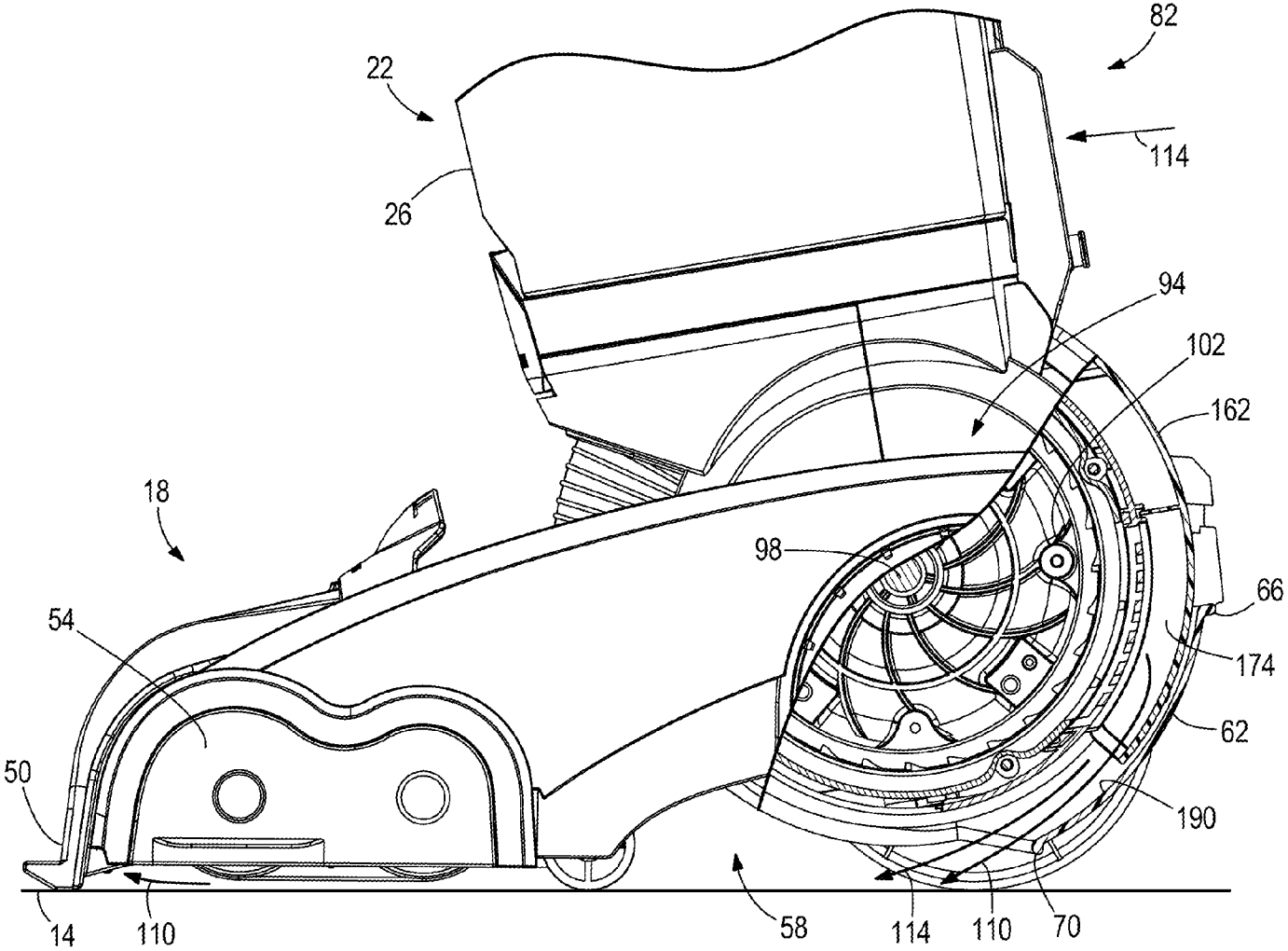
FIG. 7 is a partial cross sectional side view of a portion of the extractor cleaning machine shown in FIG. 1 in an up-right storage position.

FIG. 1 illustrates an extractor cleaning machine 10 (hereinafter referred "extractor"). In the illustrated embodiment, the extractor 10 is an upright extractor operable to clean a surface 14, such as, for example, a floor (FIG. 7). In some embodiments, the extractor 10 may be adapted to clean a variety of surfaces, such as carpets, hardwood floors, tiles, or the like. The extractor 10 distributes or sprays a cleaning fluid (e.g., water, detergent, or a mixture of water and detergent) onto the surface to clean the surface. The extractor 10 then draws the cleaning fluid and dirt from the surface, leaving the surface relatively clean. As discussed in more detail below, the extractor 10 includes an airflow discharge that at least partially dries the surface 14.

The illustrated extractor 10 includes a base 18, a body 22 coupled to the base 18, a recovery tank 26 coupled to the body 22, a fluid distribution system (not shown), and a supply tank assembly 34 coupled to the body 22. Other extractors within the scope of the invention may include a different type of base, such as including the recovery tank and or supply tank coupled to the base. The supply tank assembly 34 is configured to store cleaning fluid to be distributed by the extractor 10 onto the surface 14. The recovery tank 26 is configured to store cleaning fluid and any dirt extracted from the surface 14.

The base 18 is movable along the surface to be cleaned. In reference to FIGS. 2 and 3, two primary wheels 38 and optionally two secondary wheels 42 are coupled to the base 18 to facilitate movement of the base 18 along the surface. In the illustrated embodiment, the wheels 38, 42 are idle wheels. In other embodiments, one or more of the wheels 38, 42 may be driven wheels.

Referring to FIG. 1, the base 18 further includes a distribution nozzle (not shown) for delivering cleaning fluid, a suction nozzle 50, and a brush assembly 54 adjacent a lower surface 58 of the base 18. The distribution nozzle directs cleaning fluid toward the surface 14 to be cleaned. The suction nozzle 50 draws fluid and dirt from the surface into the recovery tank 26 of the extractor 10. The brush assembly 54 is coupled to the lower surface 58 adjacent the distribution nozzle and suction nozzle 50 to scrub the surface 14 (shown in FIG. 7). The brush assembly 54 also helps inhibit fluid from flowing beyond a periphery of the base 18. In some embodiments, individual brushes of the brush assembly 54 may be electrically or pneumatically rotated to agitate and scrub the surface.

The fluid distribution system is in fluid communication with the supply tank assembly 34 to draw cleaning fluid from the supply tank assembly 34 and distribute the fluid to the surface 14. In some embodiments, the fluid distribution system may include a pump that propels the cleaning fluid to the surface 14.

Figure 2:
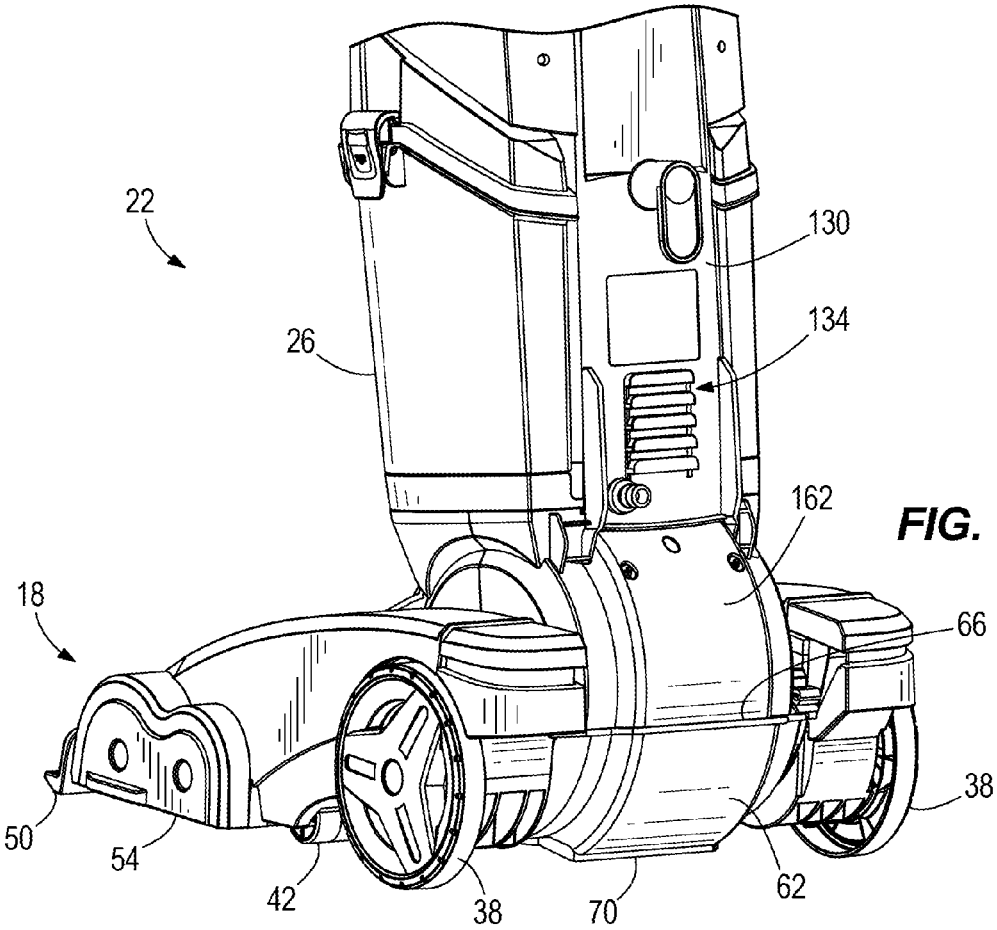
FIG. 2 is a perspective view of a rear portion of the extractor cleaning machine shown in FIG. 1.
Figure 3:
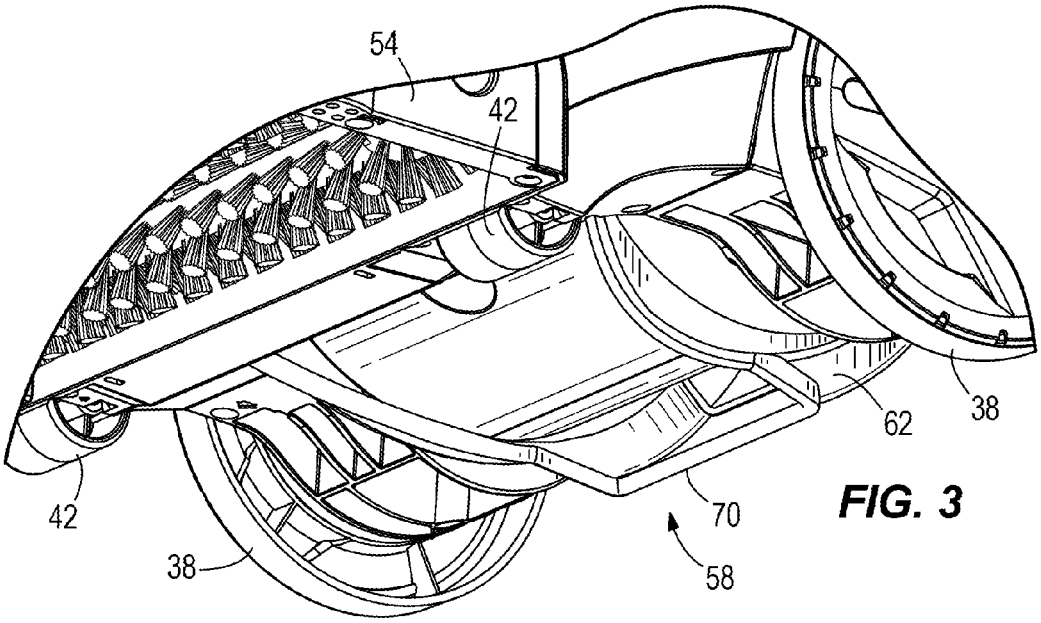
FIG. 3 is a perspective view of a lower surface of the extractor cleaning machine shown in FIG. 1.

In reference to FIGS. 2 and 3, the base 18 further includes a base exhaust duct 62 having an exhaust outlet 70 directed toward the surface to be cleaned and generally positioned opposite from the suction nozzle 50 and the brush assembly 54. In the illustrated embodiment, the base exhaust duct 62 is rigidly attached to the base 18 for movement with the base 18. The base exhaust duct 62 defines a curved member extending from an exhaust inlet 66 to the exhaust outlet 70. The exhaust outlet 70 is located at a distal end of the base exhaust duct 62 directed generally towards the surface 14 (FIG. 7). The base exhaust duct 62 generally has a rectangular cross-sectional profile. In other embodiments, the base exhaust duct 62 may be located elsewhere on the base 18 and include a different geometric profile (e.g., semicircle, oval, etc.). As discussed in more detail below, the base exhaust duct 62 directs an airflow to at least partially aid in the drying of the surface 14 being cleaned.

As shown in FIG. 1, the body 22 supports a trigger 74 and optionally a mode switch 78. The trigger 74 is actuatable to spray cleaning fluid from the supply tank assembly 34 through the distribution nozzle and onto the surface 14. The mode switch 78 adjusts the operating mode (i.e., wash, rinse, auto-rinse, etc.) of the extractor 10.

Figure 8:
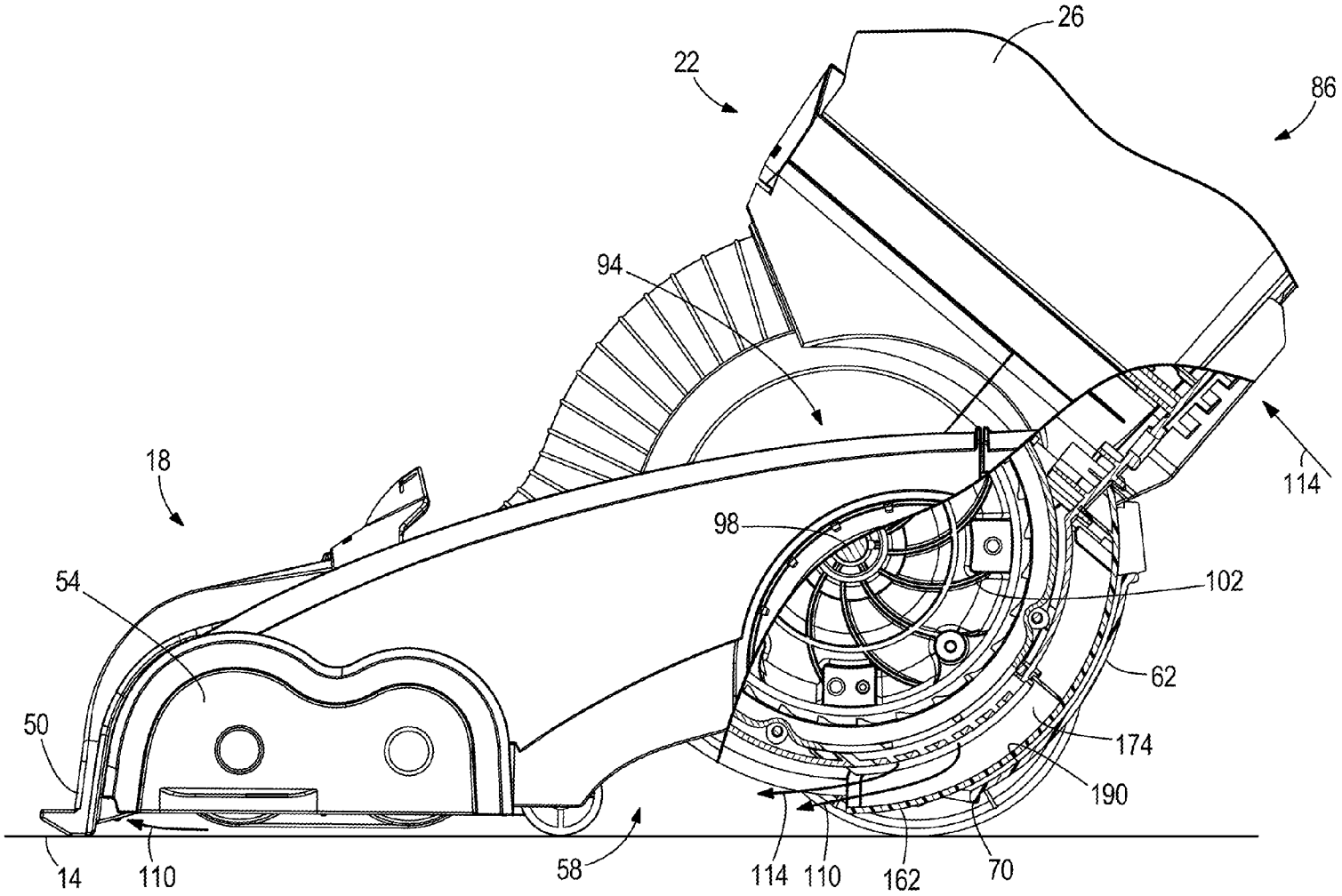
FIG. 8 is a partial cross sectional side view of a portion of the extractor cleaning machine of FIG. 1 in an inclined operating position.

In addition, the illustrated body 22 is pivotally coupled to and extends from the base 18. The body 22 is pivotable or tiltable relative to the base 18 from a generally vertical, or upright, storage position 82 shown in FIG. 7 to one or more non-vertical, or inclined, operating positions 86, one of which is shown in FIG. 8. Pivoting the body 22 to an operating position 86 facilitates moving the base 18 along the surface 14.

Figure 4:
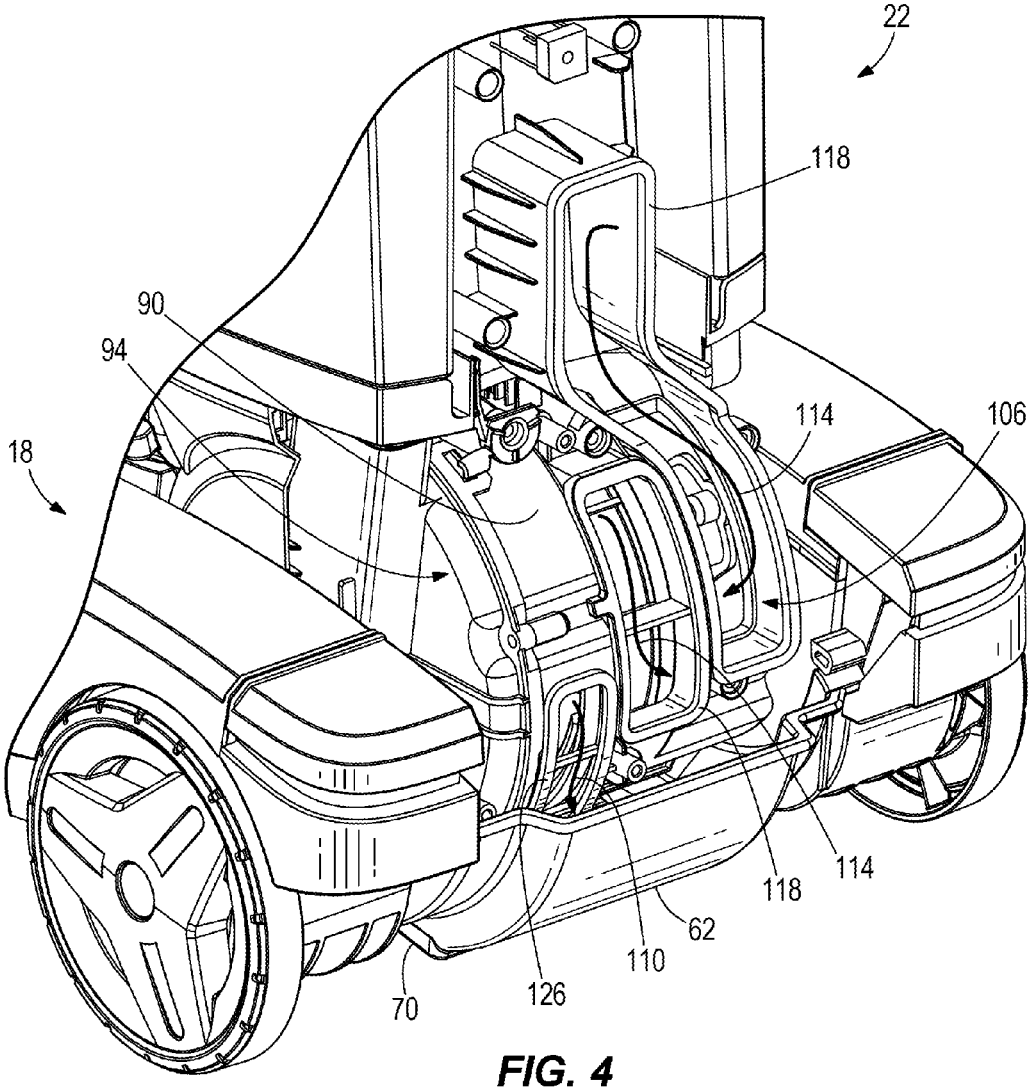
FIG. 4 is a perspective view of the rear portion of the extractor cleaning machine shown in FIG. 1 with a portion of a body removed.

In reference to FIG. 4, the body 22 includes a motor housing 90 supporting a suction source 94. The motor housing 90 is generally attached to the body 22 underneath the recovery tank 26 and is designed in a generally cylindrical configuration. In other embodiments, the suction source 94 may be supported by the base 18 or may be positioned elsewhere on the extractor 10 (FIG. 7). The suction source 94 is in fluid communication with the suction nozzle 50 to draw fluid and dirt from the surface 14 through the suction nozzle 50 and into the recovery tank 26.

In one embodiment, the suction source 94 includes an electric motor 98 operable to drive a primary fan 102 and a cooling fan 106 located at distal ends of the motor 98 (FIG. 4 and FIG. 7). The fans 102, 106 generate a primary airflow 110 and a cooling airflow 114, respectively, that are fluidly isolated from one another within the body 22. The primary airflow 110 is in fluid communication with the suction nozzle 50. However, the primary airflow 110 is fluidly isolated from the motor 98 and flows out of the machine 10 through a primary air duct 126 having a primary duct outlet 142. In addition, the cooling airflow 114 is in fluid communication with the motor 98 through a cooling air duct 118 having a cooling duct inlet 134 and a cooling duct outlet 138. The cooling duct outlet 138 and the primary duct outlet 142 are positioned to deliver the airflows 110 and 114 to the exhaust outlet 70 of the base directed toward the surface 14 to at least partially aid in the drying of the surface 14, which is described in more detail below. The cooling duct outlet 138 and the primary duct outlet 142 are generally separated from each other prior to exiting a body exhaust duct 162.

Figure 5:
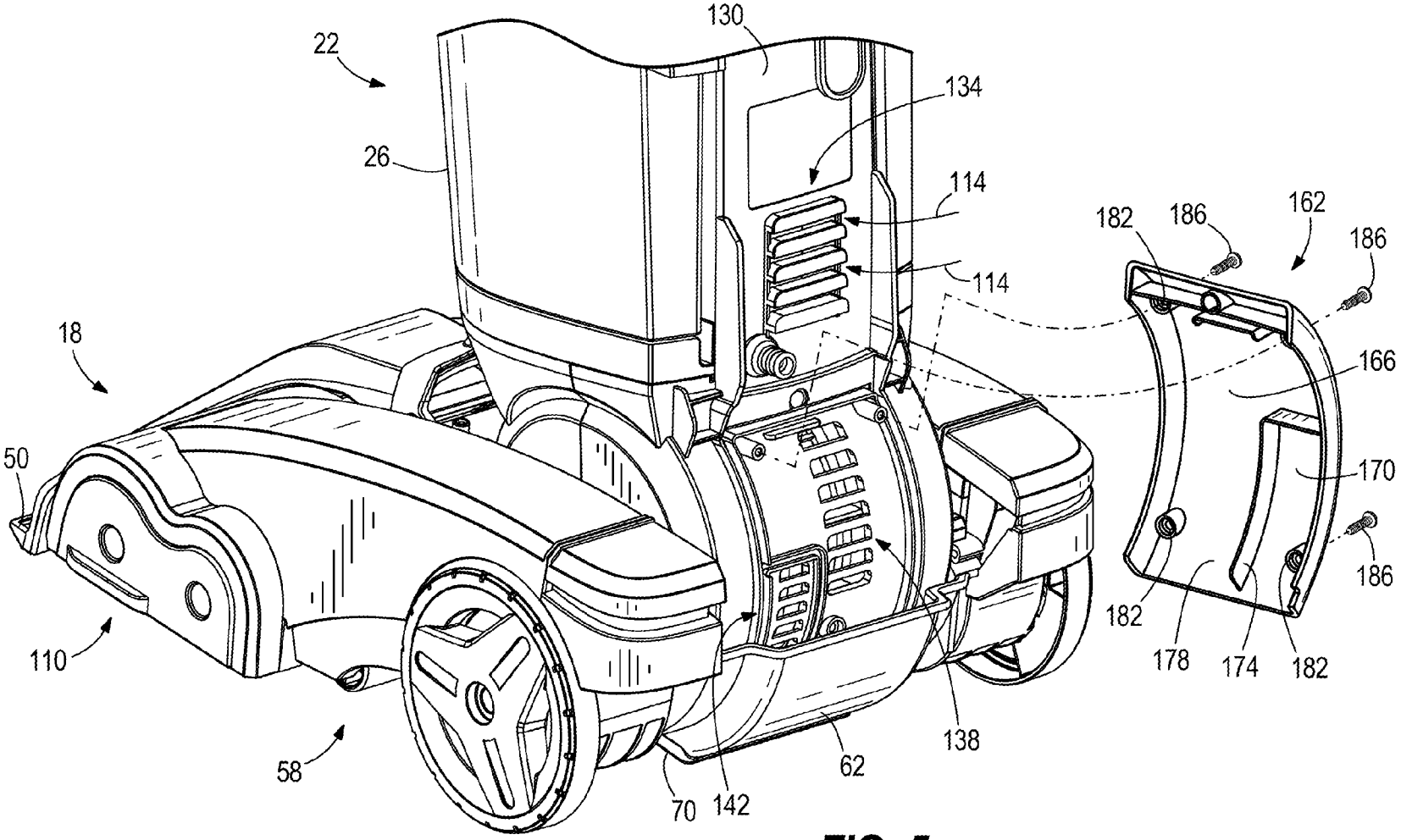
FIG. 5 is an exploded perspective view of the rear portion of the extractor cleaning machine shown in FIG. 1 including a body exhaust duct.
Figure 6:
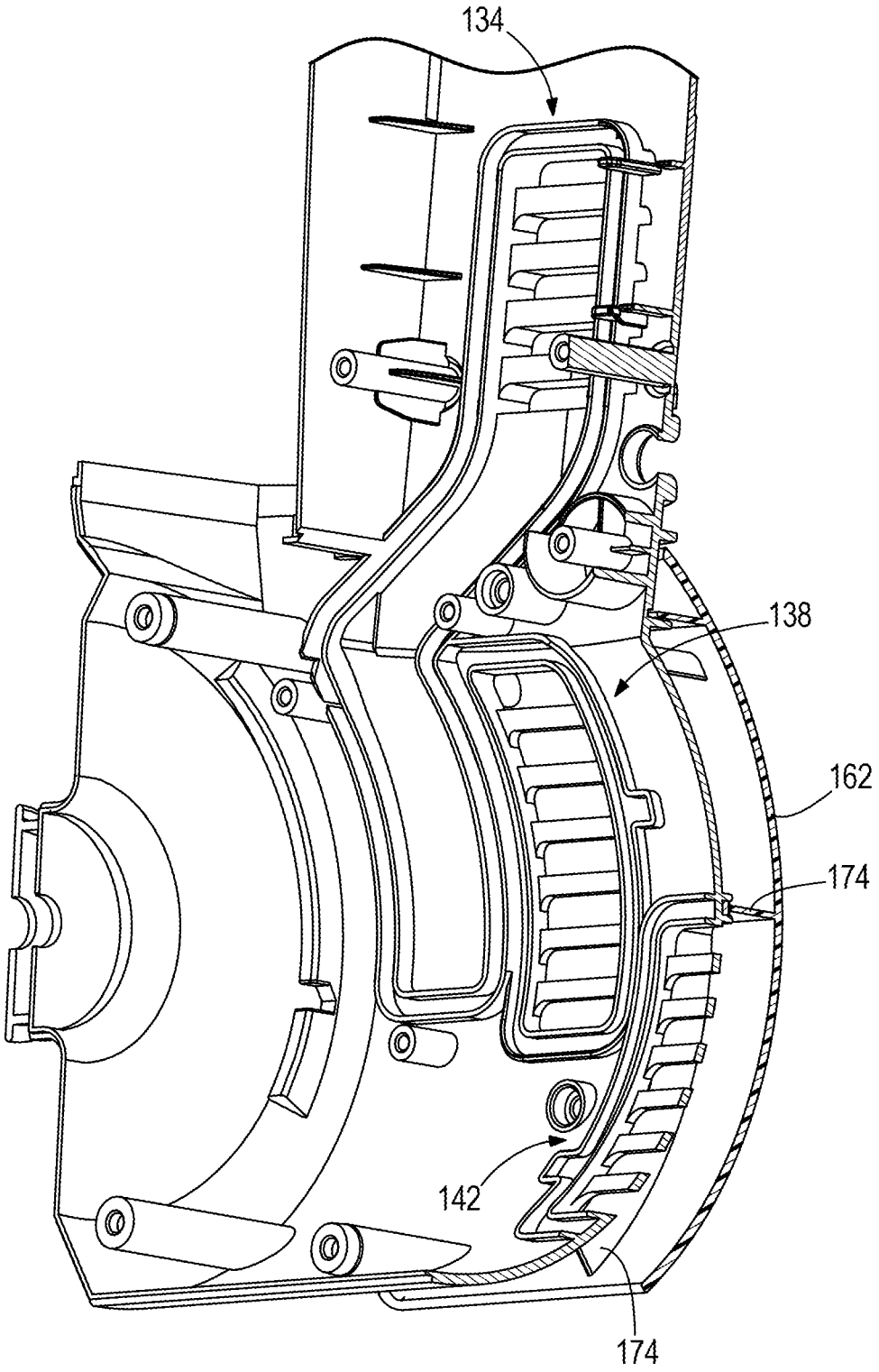
FIG. 6 is a cross sectional perspective view of a portion of the body exhaust duct and a portion of the body.

In continued reference to FIG. 5, a body exhaust duct 162 is generally formed in a semicircular configuration in the illustrated embodiment. The body exhaust duct 162 is positioned over the cooling duct outlet 138 and the primary duct outlet 142 to receive the cooling airflow 114 and the primary airflow 110. A wall 174 may be provided in the body exhaust duct 162 to isolate the cooling duct outlet 138 from the primary duct outlet 142 inhibiting the primary airflow 110 from entering the cooling duct outlet 138. Stated another way, the body exhaust duct 162 forms a first inlet aperture 166 adjacent the cooling duct outlet 138 that receives the cooling airflow 114 and a second inlet aperture 170 adjacent the primary duct outlet 142 that receives the primary airflow 110. The first and second inlet apertures 166, 170 are defined by an inner surface 178 of the body exhaust duct 162. In the illustrated embodiment, the wall 174 is shown as a two-sided member extending from the inner surface 178. In other embodiments, the wall 174 may be differently configured to guide airflow from the cooling duct outlet 138 and the primary duct outlet 142.

In reference to FIG. 2 and FIG. 5, the body exhaust duct 162 is attached to body panel 130 adjacent the motor housing 90. The body exhaust duct 162 may be secured to the body panel 130 by fasteners 186, for example by fastening through fastener holes 182 in the illustrated embodiment.

Furthermore, in reference to FIGS. 2 and 7, the base exhaust duct 62 and the body exhaust duct 162 cooperate to form an exhaust passageway 190 between the suction source 94 and the exhaust outlet 70. A portion of the body exhaust duct 162 is positioned within the exhaust inlet 66 of the base exhaust duct 62 such that airflow through the body exhaust duct 162 passes through the base exhaust duct 62. Stated another way, the body exhaust duct 162 in combination with the base exhaust duct 62 defines the exhaust passageway 190 between the suction source 94 and the exhaust outlet 70 (FIG. 7). Additionally, the body exhaust duct 162 moves relative to the base exhaust duct 62 as the handle pivots between the upright position 82 and the inclined position 86. In the illustrated embodiment, the shape of the body exhaust duct 162 cooperates with the shape of the base exhaust duct 62 such that the body exhaust duct 162 slides within the base exhaust duct 62 as the handle pivots between the upright position 82 and the inclined position 86, providing the exhaust passageway 190 in an extended or lengthened state in the upright position 82 shown in FIG. 7 and a shortened or retracted state in the inclined position 86 as shown in FIG. 8.

In operation, in reference to FIG. 7 and FIG. 8, the electric motor 98 is operable to rotate the primary fan 102 and the cooling fan 106. The primary fan 102 creates the primary airflow 110 that extracts dirt and liquid from the surface 14 through the suction nozzle 50. The primary airflow 110 is initially processed by the extractor 10 through the recovery tank 26. Before the primary airflow 110 reaches the recovery tank 26, the primary airflow contains a substantial amount of moisture from the surface 14. The recovery tank 26 collects the moisture from the primary airflow 110 before the primary airflow 110 travels towards the suction source 94. The primary airflow 110 travels adjacent the electric motor 98 and exits the body 22 through the primary air duct 126 and the primary duct outlet 142 (FIG. 5).

The cooling fan 106 creates the cooling airflow 114 that draws ambient air through the cooling duct inlet 134 and into the cooling air duct 118. The cooling airflow 114 then passes adjacent the motor 98 which absorbs heat from the motor 98. The cooling airflow 114 exits the body 22 through the cooling duct outlet 138 (FIG. 5).

With reference to FIG. 7 and FIG. 8, when the extractor 10 is in the upright position 82, the exhaust passageway 190 is in fluid communication with the exhaust outlet 70. The exhaust outlet 70 directs the primary airflow 110 and the cooling airflow 114 towards the surface 14 to act in aiding of drying the surface 14. When the extractor 10 is in the inclined operating position 86, the body exhaust duct 162 slides downward within the base exhaust duct 62. As a result, the body exhaust duct 162 extends beyond the exhaust outlet 70 and directs the primary airflow 110 and the cooling airflow 114 generally towards the suction nozzle 50 and the surface 14. The primary airflow 110 and the cooling airflow 114 act to dry the surface 14.

Various features and advantages of the invention are set forth in the following claims.

What is claimed is:

1. An extractor cleaning machine comprising:

a supply tank configured to store a cleaning fluid;

a base movable along a surface to be cleaned, the base including a base exhaust duct having an exhaust outlet directed toward the surface, the base further including a suction nozzle and an aperture configured to spray the cleaning fluid onto the surface;

a recovery tank in fluid communication with the suction nozzle and the recovery tank configured to store cleaning fluid drawn through the suction nozzle;

a suction source in fluid communication with the suction nozzle and the recovery tank, and the suction source operable to draw the cleaning fluid through the suction nozzle and into the recovery tank, the suction source operable to generate an airflow that is discharged through the exhaust outlet of the base and onto the surface; and a body pivotally coupled to the base such that the body is pivotable between an upright position and an inclined position, the body includes a body exhaust duct that is movable relative to the base exhaust duct as the body pivots between the upright position and the inclined position, and wherein the base exhaust duct and the body exhaust duct cooperate to form an exhaust passageway between the suction source and the exhaust outlet.

2. The extractor cleaning machine of claim 1, wherein a first portion of the airflow is a suction source cooling air flow that generally does not travel through the suction nozzle and the recovery tank.

3. The extractor cleaning machine of claim 2, wherein a second portion of the airflow is a primary air flow that generally travels through the suction nozzle and the recovery tank.

4. The extractor cleaning machine of claim 1, wherein the airflow is a cooling airflow, the suction source includes a cooling fan and a motor operable to rotate the cooling fan to generate the cooling airflow that is discharged through the exhaust outlet of the base.

5. The extractor cleaning machine of claim 4, wherein the body exhaust duct includes a first inlet aperture that receives the cooling airflow and a second inlet aperture that receives a primary airflow, and wherein the body exhaust duct includes a wall between the first and second inlet apertures to inhibit fluid communication between the first and second inlet apertures.

6. The extractor cleaning machine of claim 1, wherein the suction source includes a primary fan, a motor operable to rotate the primary fan to generate a primary airflow that draws the cleaning fluid through the suction nozzle and into the recovery tank, the primary airflow is discharged through the exhaust passageway and the exhaust outlet of the base.

7. The extractor cleaning machine of claim 1, wherein the body includes a cooling air inlet aperture, the airflow being drawn through the cooling air inlet aperture and directed onto a motor to cool the motor before being discharged through the exhaust passageway and the exhaust outlet of the base.

8. The extractor cleaning machine of claim 1, wherein the suction source includes a primary fan and a motor operable to rotate the primary fan to generate the airflow, wherein the airflow draws the cleaning fluid through the suction nozzle and into the recovery tank.

9. The extractor cleaning machine of claim 1, wherein the suction source includes a suction source outlet, wherein the suction source outlet discharges the airflow into the body exhaust duct.

10. The extractor cleaning machine of claim 1, wherein the body exhaust duct slides along the base exhaust duct when the body pivots between the upright storage position and the inclined operating position.

11. The extractor cleaning machine of claim 1, wherein the body exhaust duct slides inside the base exhaust duct when the body pivots between the upright storage position and the included operating position.

12. The extractor cleaning machine of claim 1, wherein the base exhaust duct if fixed from movement relative to the base.

13. The extractor cleaning machine of claim 1, wherein the supply tank is coupled to the body for movement with the body relative to the base.

14. A floor cleaning machine comprising:

a base movable along a surface to be cleaned, the base including a suction nozzle and a base exhaust duct and an exhaust outlet;

a suction source in fluid communication with the suction nozzle, and the suction source operable to generate an airflow that is discharged through the exhaust outlet; and a body portion pivotally coupled to the base, the body portion including a body exhaust duct that is movable relative to the base exhaust duct as the body pivots relative to the base, and wherein the base exhaust duct and the body exhaust duct cooperate to form an exhaust passageway between the suction source and the exhaust outlet, and wherein the body exhaust duct slides along the base exhaust duct when the body pivots relative to the base.

15. The floor cleaning machine of claim 14, wherein the airflow is a cooling airflow, the suction source includes a cooling fan and a motor operable to rotate the cooling fan to generate the cooling airflow that is discharged through the exhaust outlet of the base.

16. The floor cleaning machine of claim 15, wherein the body exhaust duct includes a first inlet aperture that receives the cooling airflow and a second inlet aperture that receives a primary airflow, and wherein the body exhaust duct includes a wall between the first and second inlet apertures to inhibit fluid communication between the first and second inlet apertures.

17. The floor cleaning machine of claim 15, wherein the body portion includes a cooling air inlet aperture, the airflow being drawn through the cooling air inlet aperture and directed onto a motor to cool the motor before being discharged through the exhaust passageway and the exhaust outlet of the base.

18. The floor cleaning machine of claim 14, wherein the suction source includes a primary fan, a motor operable to rotate the primary fan to generate a primary airflow that is drawn through the suction nozzle, the primary airflow is discharged through the exhaust passageway and the exhaust outlet.

19. The floor cleaning machine according to claim 14, where an end of the base exhaust duct forms the exhaust outlet when the body portion is in an upright position and an end of the body exhaust duct forms the exhaust outlet when the body portion is in an inclined position.

20. The floor cleaning machine according to claim 14, where the exhaust outlet is directed toward the surface to be cleaned.

21. The floor cleaning machine according to claim 14, further comprising a supply tank configured to store a cleaning fluid, a distributor in fluid communication with the supply tank configured to deliver the cleaning fluid onto the surface to be cleaned, and a recovery tank in fluid communication with a nozzle inlet and configured to store cleaning fluid drawn through the nozzle inlet from the surface.

* * * * *